US007148665B2

(12) United States Patent
Agari et al.

(10) Patent No.: US 7,148,665 B2
(45) Date of Patent: Dec. 12, 2006

(54) POWER SUPPLYING METHODS AND APPARATUS THAT PROVIDE STABLE OUTPUT VOLTAGE

(75) Inventors: Hideki Agari, Osaka (JP); Hirohisa Abe, Hyogo-ken (JP); Kohji Yoshii, Hyogo-ken (JP)

(73) Assignee: Ricoh Company, Ltd., Tokyo (JP)

( * ) Notice: Subject to any disclaimer, the term of this patent is extended or adjusted under 35 U.S.C. 154(b) by 41 days.

(21) Appl. No.: 10/625,698

(22) Filed: Jul. 24, 2003

(65) Prior Publication Data

US 2004/0174149 A1 Sep. 9, 2004

(30) Foreign Application Priority Data

Jul. 25, 2002 (JP) ..... 2002-216929

(51) Int. Cl.
*G05F 1/59* (2006.01)

(52) U.S. Cl. ..... 323/268; 323/272; 323/350

(58) Field of Classification Search ..... 323/268, 323/269, 272, 350

See application file for complete search history.

(56) References Cited

U.S. PATENT DOCUMENTS

| | | | | |
|---|---|---|---|---|
| 4,074,182 | A | 2/1978 | Weischedel | |
| 4,502,152 | A * | 2/1985 | Sinclair | 455/73 |
| 5,083,078 | A * | 1/1992 | Kubler et al. | 323/268 |
| 5,258,701 | A | 11/1993 | Pizzi et al. | |
| 6,031,780 | A | 2/2000 | Abe | |
| 6,104,057 | A | 8/2000 | Nakanishi et al. | |
| 6,115,292 | A | 9/2000 | Fukuda et al. | |
| 6,130,526 | A | 10/2000 | Yang et al. | |
| 6,236,194 | B1 | 5/2001 | Manabe et al. | |
| 6,249,110 | B1 | 6/2001 | Geyer et al. | |
| 6,597,158 | B1 * | 7/2003 | Umeda | 323/268 |
| 6,636,023 | B1 * | 10/2003 | Amin | 323/268 |
| 6,654,264 | B1 * | 11/2003 | Rose | 363/65 |
| 6,661,210 | B1 * | 12/2003 | Kimball et al. | 323/268 |
| 6,661,211 | B1 * | 12/2003 | Currelly et al. | 323/268 |
| 6,903,538 | B1 * | 6/2005 | Umeda et al. | 323/268 |
| 2001/0007134 | A1 | 7/2001 | Odaohhara | |
| 2002/0041178 | A1 | 4/2002 | Hiraki et al. | |

FOREIGN PATENT DOCUMENTS

| | | |
|---|---|---|
| GB | 2 027 957 A | 2/1980 |
| JP | 2001-197731 | 7/2001 |

* cited by examiner

*Primary Examiner*—Jeffrey Sterrett
(74) *Attorney, Agent, or Firm*—Dickstein Shapiro LLP

(57) ABSTRACT

A direct current power supply apparatus includes a first power supply circuit and a second power supply circuit. The first power supply circuit converts a source voltage from an externally supplied direct current power source into a first voltage and provides the first voltage to an output terminal. The second power supply circuit converts the source voltage from the externally supplied direct current power source into a second voltage and provides the second voltage to the output terminal. The second power supply circuit is controlled to be turned on and off. The first power supply circuit detects voltage at the output terminal and, when the second voltage is not being provided because the second power supply circuit is inactivated, provides the first voltage.

17 Claims, 5 Drawing Sheets

POWER SUPPLYING METHODS AND APPARATUS THAT PROVIDE STABLE OUTPUT VOLTAGE

This patent application claims priority from Japanese patent application No. 2002-216929, filed on Jul. 25, 2002 in the Japan Patent Office, the entire contents of which are incorporated by reference herein.

FIELD OF THE INVENTION

The present invention relates to power supplying methods and apparatus, and more particularly to power supplying methods and apparatus in which a stable output voltage is provided by detecting output voltage.

BACKGROUND OF THE INVENTION

Saving electric power has been one of the key improvements in electric equipment in recent years, often in consideration of environmental issues. This trend is particularly obvious in electric appliances powered by batteries. General means for achieving power savings include cutting back on waste of electric power consumed by an electric machine and increasing efficiency of a power supply source of the electric machine. In one example, when an electric machine is in a non-operative state, the machine is held in a standby state to stop the operations of circuits in the machine so as to reduce power consumption. When, however, the power supply source itself has low efficiency, a sufficient power savings cannot be expected.

Switching regulators and series regulators are common electric circuits used as power supply apparatuses. The switching regulator generally has a relatively high efficiency at rated load. On the other hand, it has relatively large output voltage ripples and produces noise in operation, and its internal power consumption becomes relatively large. Therefore, when supplying a power to a light load that consumes a relatively light current, the switching regulator has dramatically reduced efficiency. Moreover, the switching regulator has relatively low output voltage stability since it is relatively slow in raising output voltage and in responding to variations in input voltage and to load fluctuation.

The series regulator has a relatively low efficiency due to a relatively large power consumption of an output control transistor when supplying electric power to a heavy load that consumes a relatively large current, but has less output voltage ripple and produces relatively little noise in operation. In addition, the series regulator allows reduction of internal power consumption of the power supply control circuit itself. Therefore, some series regulators are more efficient than a switching regulator when the load is relatively small. Furthermore, the series regulator can easily raise the output voltage and quickly respond to variations in input voltage and to load fluctuation. In addition, the series regulator has relatively high output voltage stability.

As an example, Japanese Laid-Open Patent Application Publication No. 2001-197731 describes a power supply apparatus including both a switching regulator and a series regulator. This power supply apparatus activates one of the regulators depending on load current in order to increase power supply circuit efficiency.

FIG. 1 shows a schematic circuit diagram of a DC-to-DC converter 66, an example of a power supply apparatus described in the above Publication No. 2001-197731. In FIG. 1, the DC-to-DC converter 66 includes a series power supply (SPS) circuit 100 and a switching power supply circuit 102. The series power supply circuit 100 has a nearly constant electric power conversion efficiency of approximately 70%, regardless of the load current. The switching power supply circuit 102 provides efficiency greater than 80% at a relatively large load current while providing reduced efficiency as the load current becomes smaller. That is, this DC-to-DC converter 66 activates the series power supply circuit 100 for a light load and the switching power supply circuit 102 for a heavy load.

Each of the series power supply circuit 100 and a PWM (pulse width modulation) controller 108 included in the switching power supply circuit 102 has an enable (EN) terminal. When the enable terminal of one of the circuits is in a low state and is activated, the corresponding power supply circuit is caused to output a predetermined voltage. In other words, at a heavy load, the switching power supply circuit 102 is activated and, at the same time, the series power supply circuit 100 is inactivated by changing a standby signal input to an input terminal 109 to a low state. On the other hand, at a light load, the standby signal is changed to a high state to stop the operations of the switching power supply circuit 102 and to activate the series power supply circuit 100. In this way, at a light load, the series power supply circuit 100 is used in place of the switching power supply circuit 102, which has reduced efficiency at a light load. Therefore, the overall efficiency of the DC-to-DC converter 66 is increased.

However, the DC-to-DC converter 66 is required to have a switching circuit 116 to switch between the series power supply circuit 100 and the switching power supply circuit 102 and also an enable terminal for each of the series power supply circuit 100 and the PWM controller 108 of the switching power supply circuit 102. This makes the circuit of the DC-to-DC converter 66 more complex and accordingly increases manufacturing cost. Furthermore, when the standby signal is changed from the low state to the high state, the switching power supply circuit 102 would immediately lower its output voltage but the series power supply circuit 100 may delay in raising the output voltage to a predetermined level. Therefore, an output voltage at a common output terminal may momentarily drop, a problem referred to as an undershoot.

It would be advantageous to have improved power supply techniques that are efficient yet avoid problems such as undershoot.

SUMMARY OF THE INVENTION

The present invention provides power supply techniques in which power circuits are switched to supply an output voltage in response to the output voltage.

In one exemplary embodiment, a novel direct current power supply apparatus includes a first power supply circuit and a second power supply circuit. The first power supply circuit converts a source voltage from of an externally supplied direct current power source into a first voltage and provides the first voltage to an output terminal. The second power supply circuit converts the source voltage from the externally supplied direct current power source into a second voltage and provides the second voltage to the output terminal. This second power supply circuit is turns on and off in response to a control signal. In this direct current power supply apparatus, the first power supply circuit detects voltage at the output terminal and provides the first voltage when the second voltage is not being provided, such as when the second power supply circuit is inactivated by the control signal.

The first power supply circuit may adjust an output current to the output terminal so that the voltage detected at the output terminal becomes equal to the first voltage, and the first voltage may be smaller than the second voltage.

The first power supply circuit may include a series regulator that includes a first reference voltage generator, a first voltage divider, an output control transistor, and a first operational amplifier. The first reference voltage generator generates a first reference voltage. The first voltage divider divides a voltage at the output terminal and provides a first divided voltage. The output control transistor controls output of a source current supplied by the externally input direct current power source in accordance with a gate signal. The first operational amplifier provides the gate signal to the output control transistor such that the first divided voltage from the first voltage divider becomes equal to the first reference voltage.

The second power supply circuit may include a switching regulator that includes a second reference voltage generator, a second voltage divider, a switching transistor, a second operational amplifier, a control circuit, and a smoothing circuit. The second reference voltage generator generates a second reference voltage. The second voltage divider divides voltage at the output terminal and provides a second divided voltage. The switching transistor switches an output of the source voltage supplied by the externally input direct current power source in accordance with a gate signal. The second operational amplifier amplifies a difference in voltage between the second reference voltage and the second divided voltage. The control circuit changes its state according to externally input control signals into one of an active state in which the control circuit controls switching operations of the switching transistor in accordance with an output signal from the second operational amplifier and an inactive state in which the control circuit causes the switching transistor to turn off into an interrupted state. The smoothing circuit smoothes a signal output from the switching transistor and provides a resultant signal to the output terminal.

The second power supply circuit may include a series regulator that includes a third reference voltage generator, a third voltage divider, an output control transistor, and a third operational amplifier. The third reference voltage generator generates a third reference voltage. The third voltage divider divides voltage at the output terminal and provides a third divided voltage. The output control transistor controls output of a source current supplied by the externally input direct current power source in accordance with a gate signal. The third operational amplifier provides the gate signal to the output control transistor such that the third divided voltage from the third voltage divider becomes equal to the third reference voltage.

The first power supply circuit and a portion of the second power supply circuit including the second reference voltage generator, the second voltage divider, the second operational amplifier, and the control circuit may be integrated into a single integrated circuit.

The first power supply circuit and a portion of the second power supply circuit including the second reference voltage generator, the second voltage divider, the switching transistor, the second operational amplifier, and the control circuit may be integrated into a single integrated circuit.

The smoothing circuit may include a transistor that is controlled by the control circuit to operate as a flywheel diode, and the first power supply circuit and a portion of the second power supply circuit including the second reference voltage generator, the second voltage divider, the second operational amplifier, the control circuit, and the transistor of the smoothing circuit may be integrated into a single integrated circuit.

The smoothing circuit may include a transistor that is controlled by the control circuit to operate as a flywheel diode, and the first power supply circuit and a portion of the second power supply circuit including the second reference voltage generator, the second voltage divider, the switching transistor, the second operational amplifier, the control circuit, and the transistor of the smoothing circuit may be integrated into a single integrated circuit.

The above-mentioned power supply apparatus may further include a switching element between an output port of the first power supply circuit and the output terminal. In this case, the switching element is turned off into an interrupted state while the second power supply circuit provides the second voltage.

The switching element may include a diode is connected in a forward direction between the output port of the first power supply circuit and the output terminal to allow current flow from the output port of the first power supply circuit to the output terminal.

The first power supply circuit, the switching element, and a portion of the second power supply circuit including the second reference voltage generator, the second voltage divider, the second operational amplifier, and the control circuit may be integrated into a single integrated circuit.

The first power supply circuit, the switching element, and a portion of the second power supply circuit including the second reference voltage generator, the second voltage divider, the switching transistor, the second operational amplifier, and the control circuit may be integrated into a single integrated circuit.

The smoothing circuit may include a transistor that is controlled by the control circuit to operate as a flywheel diode, and the first power supply circuit, the switching element, and a portion of the second power supply circuit including the second reference voltage generator, the second voltage divider, the second operational amplifier, the control circuit, and the transistor of the smoothing circuit may be integrated into a single integrated circuit.

The smoothing circuit may include a transistor that is controlled by the control circuit to operate as a flywheel diode, and the first power supply circuit, switching element, and a portion of the second power supply circuit including the second reference voltage generator, the second voltage divider, the switching transistor, the second operational amplifier, the control circuit, and the transistor of the smoothing circuit may be integrated into a single integrated circuit.

BRIEF DESCRIPTION OF THE DRAWINGS

A more complete appreciation of the disclosure and many of the attendant advantages thereof will be readily obtained as the same become better understood by reference to the following detailed description when considered in connection with the accompanying drawings, wherein.

Figure 1:
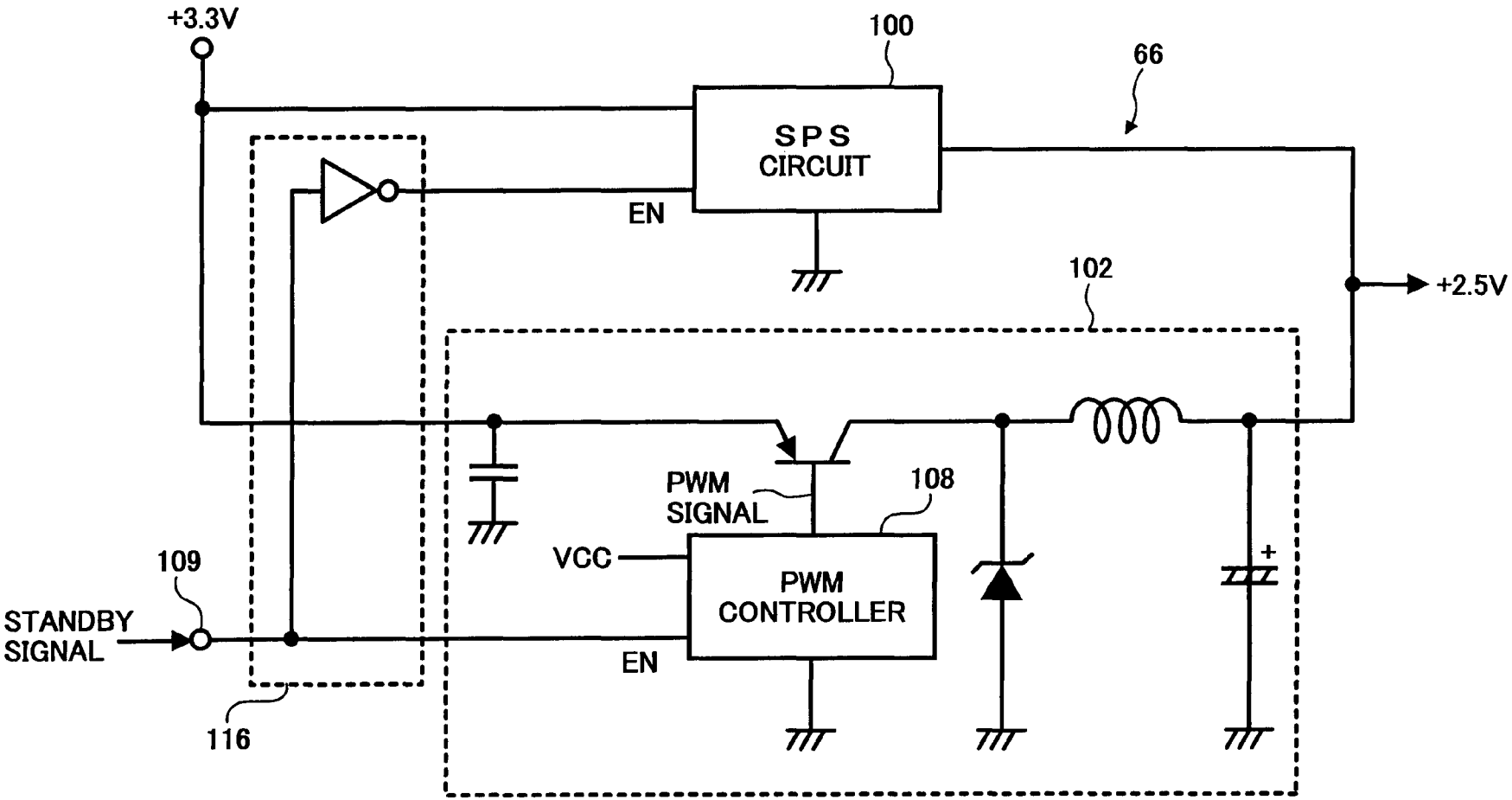
FIG. 1 PRIOR ART
FIG. 1 is a block diagram of a conventional direct current power supply apparatus.
Figure 2:
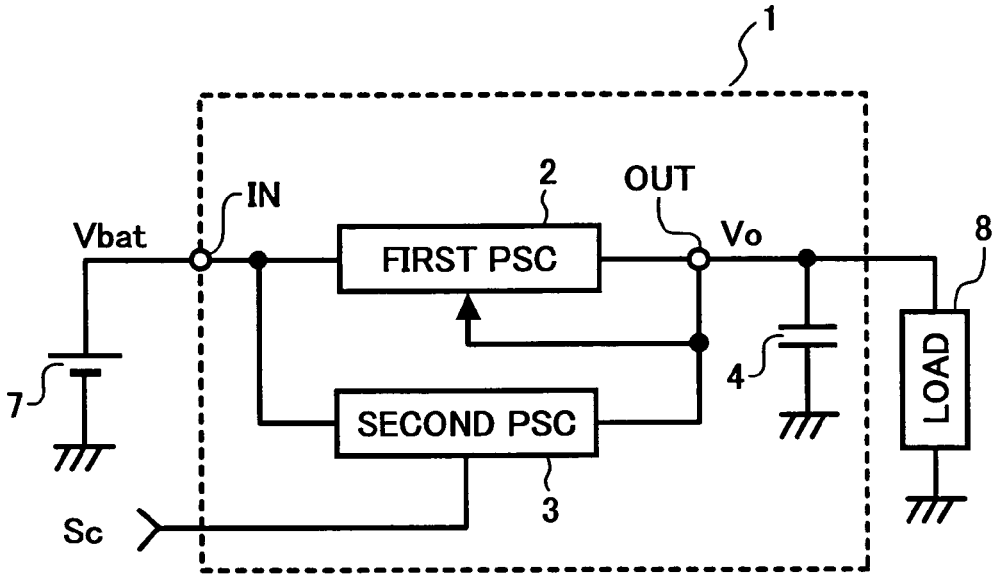
FIG. 2 is a circuit diagram of a direct current power supply apparatus according to an exemplary embodiment of the present invention.
Figure 6:
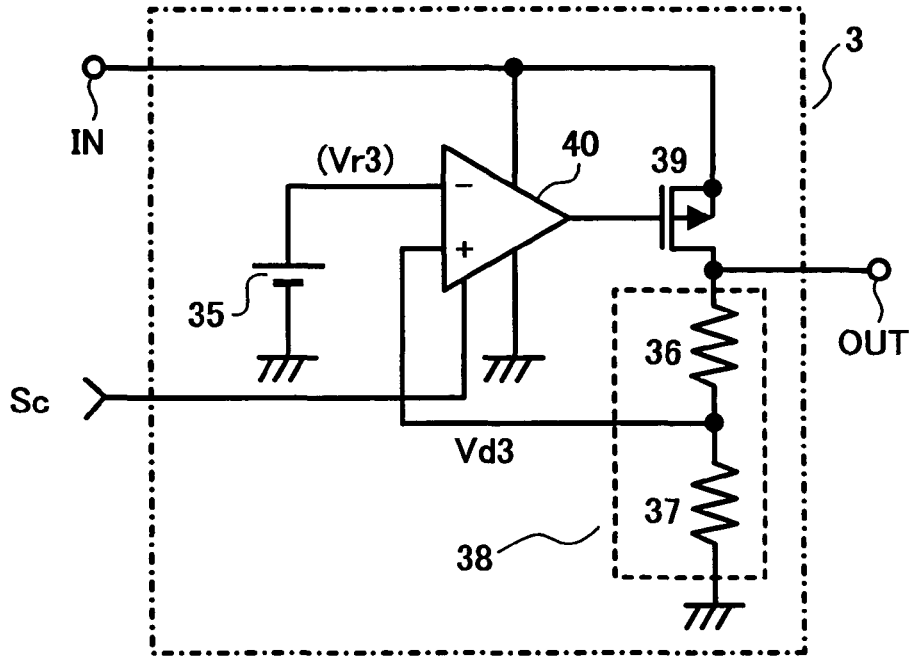
Figure 7:
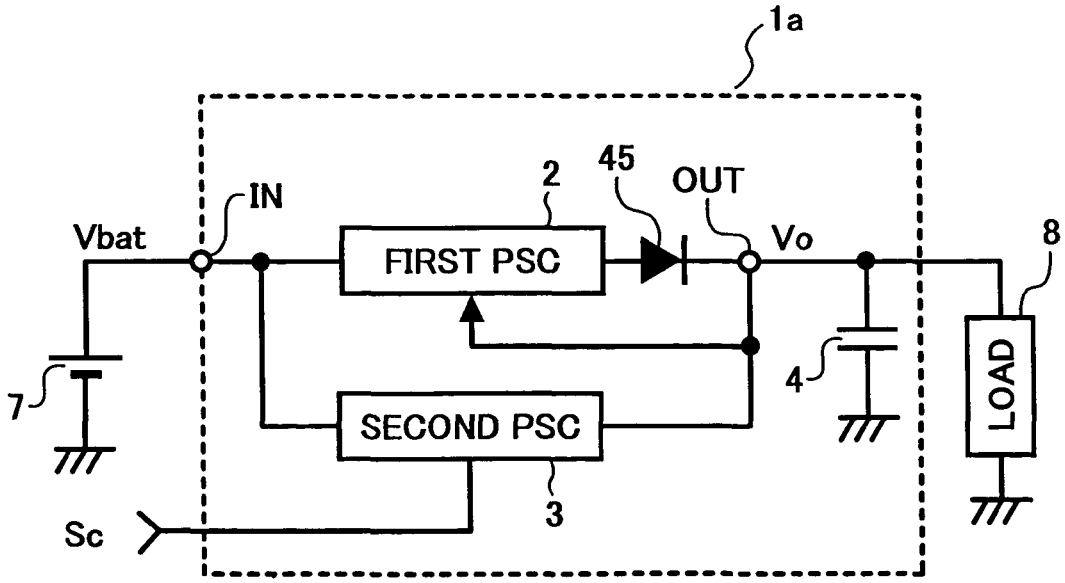

FIG, 5 is a circuit diagram of another second power supply circuit of the direct current power supply apparatus of FIG. 2;

FIG. 6 is a circuit diagram of another second power supply circuit of the direct current power supply apparatus of FIG. 2; and FIG. 7 is a circuit diagram of a direct current power supply apparatus according to another exemplary embodiment of the present invention.

DETAILED DESCRIPTION OF THE INVENTION

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

In the drawings, like reference numerals designate identical or corresponding parts throughout the several views.

FIG. 2 illustrates a direct current (DC) power supply apparatus 1 according to an exemplary embodiment of the present invention. As shown in FIG. 2, the direct current (DC) power supply apparatus 1 includes a first power supply circuit (PSC) 2, a second power supply circuit (PSC) 3, and a capacitor 4. The DC power supply apparatus 1 has an input terminal IN through which the apparatus 1 receives a voltage Vbat generated by a direct current (DC) power source 7 such as a battery, for example, and an output terminal OUT to which a load 8 is connected. This DC power supply apparatus 1 generates a stable output voltage by converting the input voltage Vbat, and outputs the output voltage to the load 8.

The first power supply circuit 2 generates a fixed output voltage Va by converting the input voltage Vbat, and outputs Va to the output terminal OUT. The second power supply circuit 3 generates another fixed output voltage Vb by converting the voltage Vbat, and outputs Vb to the output terminal OUT. The first and second power circuits 2 and 3 are each connected in series between the input terminal IN and the output terminal OUT, parallel to each other. The capacitor 4 is connected between the output terminal OUT and a ground voltage.

The first power supply circuit 2 is a power supply circuit that operates at a relatively high efficiency when it supplies a fixed voltage to a relatively light load that consumes a relatively small current. The second power supply circuit 3 is a power supply circuit that operates at a relatively high efficiency when supplying a fixed voltage to a relatively heavy load that consumes a relatively large current; circuit 3, however, operates at decreased efficiency when supplying a fixed voltage to a relatively light load. The first power supply circuit 2 detects a voltage Vo at the output terminal OUT and operates such that the detected voltage Vo is adjusted to the fixed voltage Va. For example, when the second power supply circuit 3 supplies a zero voltage to the output terminal OUT, the first power supply circuit 2 accordingly detects a reduction of the voltage Vo at the output terminal OUT and adjusts the output voltage to the fixed voltage Va.

The second power supply circuit 3 operates in accordance with a control signal Sc that is externally input to the second power supply circuit 3 from an external signal source through a control signal input terminal of the DC power supply apparatus 1. For example, when the control signal Sc is at a low level L lower than a predetermined threshold voltage, the second power supply circuit 3 is ins an operative state in which it generates and outputs the fixed voltage Vb. When the control signal Sc is at a high level H higher than the predetermined threshold voltage, the second power supply circuit 3 is in a non-operative state in which its operation stops, thereby reducing its own power consumption to almost zero.

In this way, the first power supply circuit 2 controls whether or not it outputs the voltage Va to the output terminal OUT based on detection of the output voltage Vb from the second power supply circuit 3. Therefore, the first power supply circuit 2 needs no control signal for switching between operative and non-operative states. This makes the DC power supply apparatus 1 small in size and leads to a reduction of its manufacturing cost.

In the DC power supply apparatus 1, the capacitor 4 is given a role in removing ripples of the output voltages from the first and second power supply circuits 2 and 3. The capacitor 4 also functions to limit the variations of the output voltages due to delays in response to variations in the output current to the load 8 by the first and second power supply circuits 2 and 3. Further, the capacitor 4 functions to stabilize the output voltage Vo so that the output voltage Vo does not produce an undershoot when the second power supply circuit 3 enters its non-operative state, at which time the output voltage Vo decreases, until the first power supply circuit 2 is thereby caused to output the voltage Va.

Figure 3:
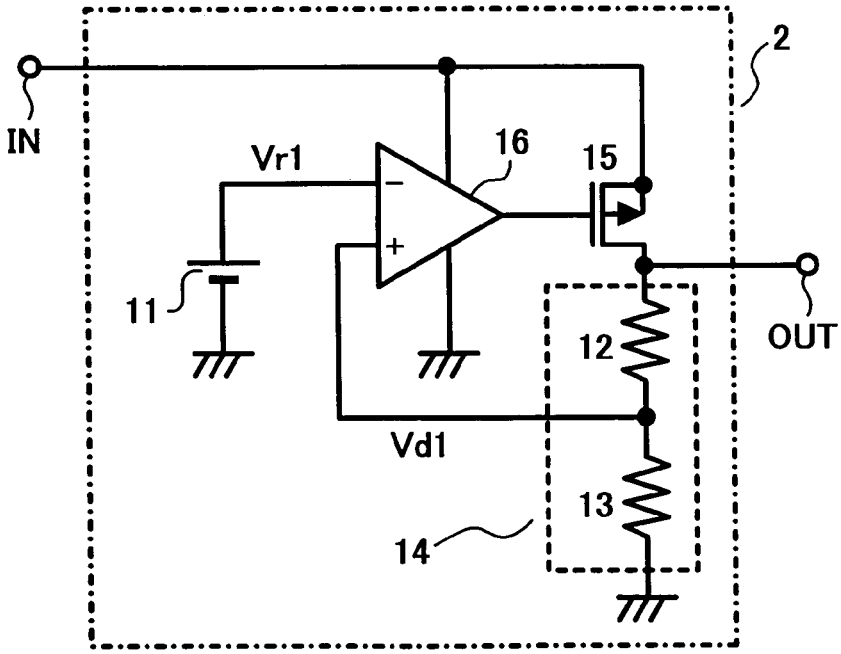
FIG. 3 is a circuit diagram of a first power supply circuit of the direct current power supply apparatus of FIG. 2.

FIG. 3 shows a more detailed exemplary embodiment of the first power supply circuit 2. As shown in FIG. 3, the first power supply circuit 2 includes a reference voltage source 11, a voltage divider 14, an output control transistor 15, and an operational amplifier 16. The voltage divider 14 includes resistors 12 and 13. The reference voltage source 11 generates and outputs a predetermined reference voltage Vr1. The voltage divider 14 divides the output voltage Vo with the resistors 12 and 13 and outputs a resultant voltage Vd1. The output control transistor 15 is a P-channel MOS (metal oxide semiconductor) transistor and outputs a current to the output terminal OUT in accordance with a voltage applied to a gate thereof. The operational amplifier 16 controls the operations of the output control transistor 15 such that the divided voltage Vd1 from the voltage divider 14 is substantially equal to the reference voltage Vr1.

The operational amplifier 16 has a non-inverting input terminal to receive the divided voltage Vd1 from the voltage divider 14 and an inverting input terminal to receive the reference voltage Vr1 from the reference voltage source 11. The operational amplifier 16 amplifies a difference of these input voltages and outputs a resultant voltage to the gate of the output control transistor 15, providing a high signal that turns off transistor 15 when Vd1 is greater than Vr1 and a low signal that turns on transistor 15 when Vd1 is less than Vr1. Thus, the operational amplifier 16 controls the operations of the output control transistor 15 in order to stabilize the output voltage Vo at a desired voltage Va, which is related to Vr1 in accordance with the sizes of resistors 12 and 13.

Figure 4:
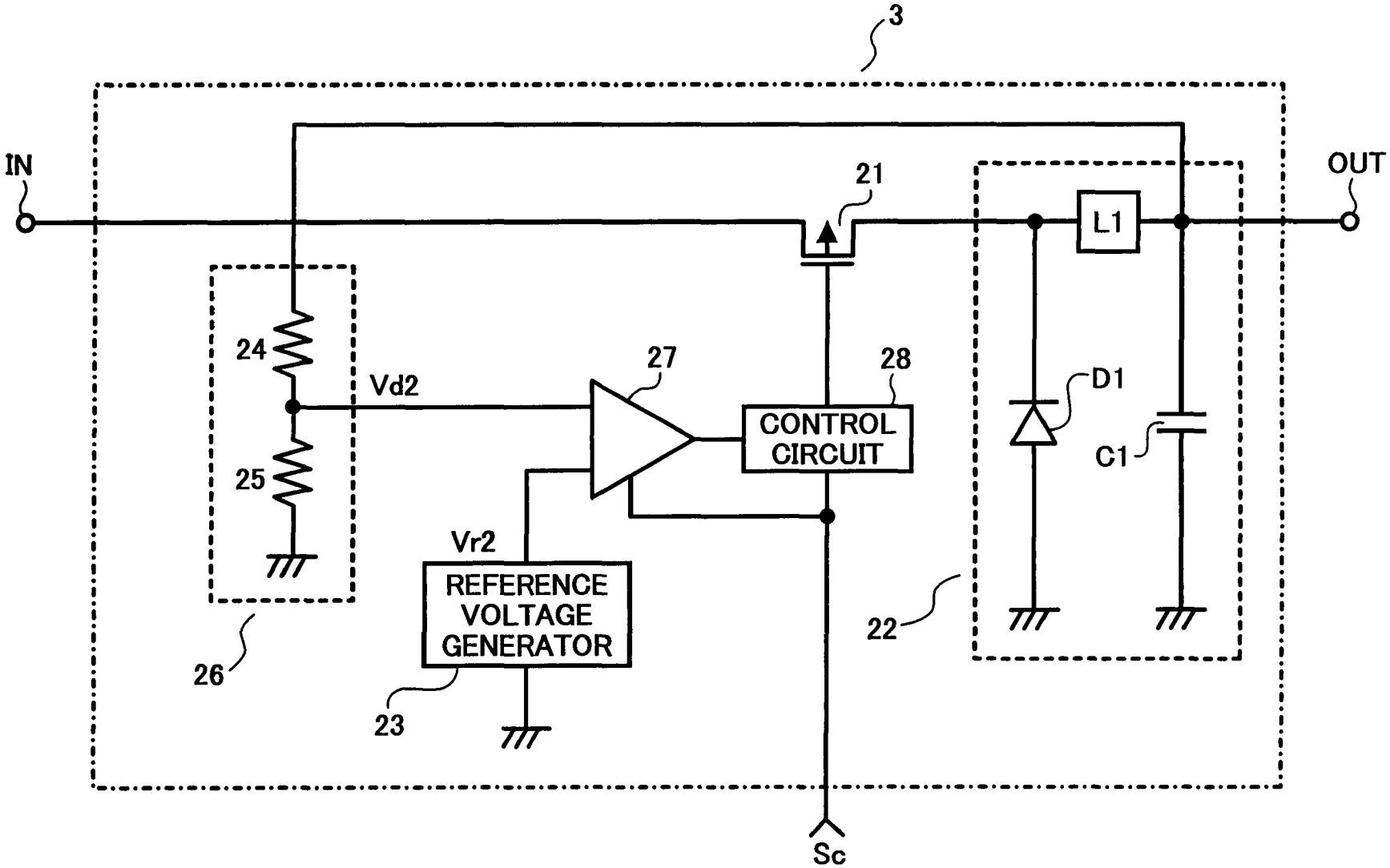
FIG. 4 is a circuit diagram of a second power supply circuit of the direct current power supply apparatus of FIG. 2.

FIG. 4 shows a detailed exemplary embodiment of the second power supply circuit 3. As shown in FIG. 4, the second power supply circuit 3 includes a switching transistor 21, a smoothing circuit 22, a reference voltage generator 23, a voltage divider 26, an operational amplifier 27, and a control circuit 28. The switching transistor 21 is a P-channel MOS (metal oxide semiconductor) transistor for switching on and off to output the voltage Vbat input from the direct current power source 7. The smoothing circuit 22 smoothes the output signal from the switching transistor 21 and outputs it to the output terminal OUT.

The reference voltage generator 23 generates and outputs a predetermined reference voltage Vr2. The voltage divider 26 includes resistors 24 and 25 and divides the voltage Vo from the output terminal OUT to output a divided voltage Vd2. The operational amplifier 27 amplifies a voltage difference between the reference voltage Vr2 and the voltage Vd2. The control circuit 28 controls the switching operations of the switching transistor 21 in accordance with the output signal from the operational amplifier 27.

The operational amplifier 27 receives at its input terminals the divided voltage Vd2 from the voltage divider 26 and the reference voltage Vr2 from the reference voltage generator 23. The operational amplifier 27 amplifies a difference of these input voltages Vd2 and Vr2. A control signal Sc is applied to both the operational amplifier 27 and the control circuit 28. These two components are brought into an operative state when the control signal Sc is in the low state. However, when the control signal Sc is in the high state, the operational amplifier 27 and the control circuit 28 are nonconductive and control circuit 28 provides an output signal that turns off switching transistor 21 to stop the output of the voltage Vbat to the output terminal OUT and also to reduce the electric power consumption of the second power supply circuit 3 itself to an almost zero level.

The control circuit 28 includes an oscillator (not shown) for generating a signal such as a triangular-wave-formed pulse signal and a comparator (not shown). The comparator compares voltages of output signals from the oscillator and the operational amplifier 27. The control circuit 28 controls a time period that the switching transistor 21 turns on in accordance with the comparison results. The output signal from the switching transistor 21 is smoothed by the smoothing circuit 22, which includes a diode D1 serving as a flywheel diode, an electric coil L1, and a capacitor C1. The smoothed output signal is then output to the output terminal OUT.

In the above-described embodiment of second power supply circuit 3, an output voltage Vo1 output from the first power supply circuit 2 is set to a value slightly smaller than that of an output voltage Vo2 output from the second power supply circuit 3. That is, the first and second power supply circuits 2 and 3 are designed such that the output voltage Vo1 is set to 1.8 volts, for example, and the output voltage Vo2 is set to 1.9 volts, for example. In this case, the second power supply circuit 3 turns on when the control signal Sc is in the low state. Accordingly, the output voltage Vo2 becomes 1.9 volts and the voltage Vo at the output terminal OUT becomes 1.9 volts as well. The feedback loop in the first power supply circuit 2 attempts to reduce the output voltage Vo to 1.8 volts, that is, the operational amplifier 16 increases the gate voltage of the output control transistor 15 because Vd1 exceeds Vr1. The output voltage Vo, however, is fixed to 1.9 volts by the second power supply circuit 3, and the operational amplifier 16 therefore turns off the output control transistor 15. As a result, the first power supply circuit 2 stops outputting the voltage Vo1.

When the control signal Sc goes into the high state, the second power supply circuit 3 becomes non-operative and consequently stops outputting the voltage Vo2 to the output terminal OUT. As a result, the output voltage Vo at the output terminal OUT decreases. When the voltage Vo at the output terminal OUT decreases to a voltage smaller than 1.8 volts, for example, the feedback loop of the first power supply circuit 2 is activated and the first power supply circuit 2 fixes the output voltage output to the output terminal OUT to 1.8 volts. Thus, by making the output voltage Vo1 output from the first power supply circuit 2 slightly smaller than the output voltage Vo2 output from the second power supply circuit 3, it becomes possible to control the output voltage of the first power supply circuit 2 without the need to add an extra input terminal for the control signal to the first power supply circuit 2.

The first power supply circuit 2 and several components of the second power supply circuit 3 including the reference voltage generator 23, the voltage divider 26, the operational amplifier 27, and the control circuit 28 are integrated into a single IC (integrated circuit). In addition, it is also possible to integrate the switching transistor 21 into this single IC.

Figure 5:
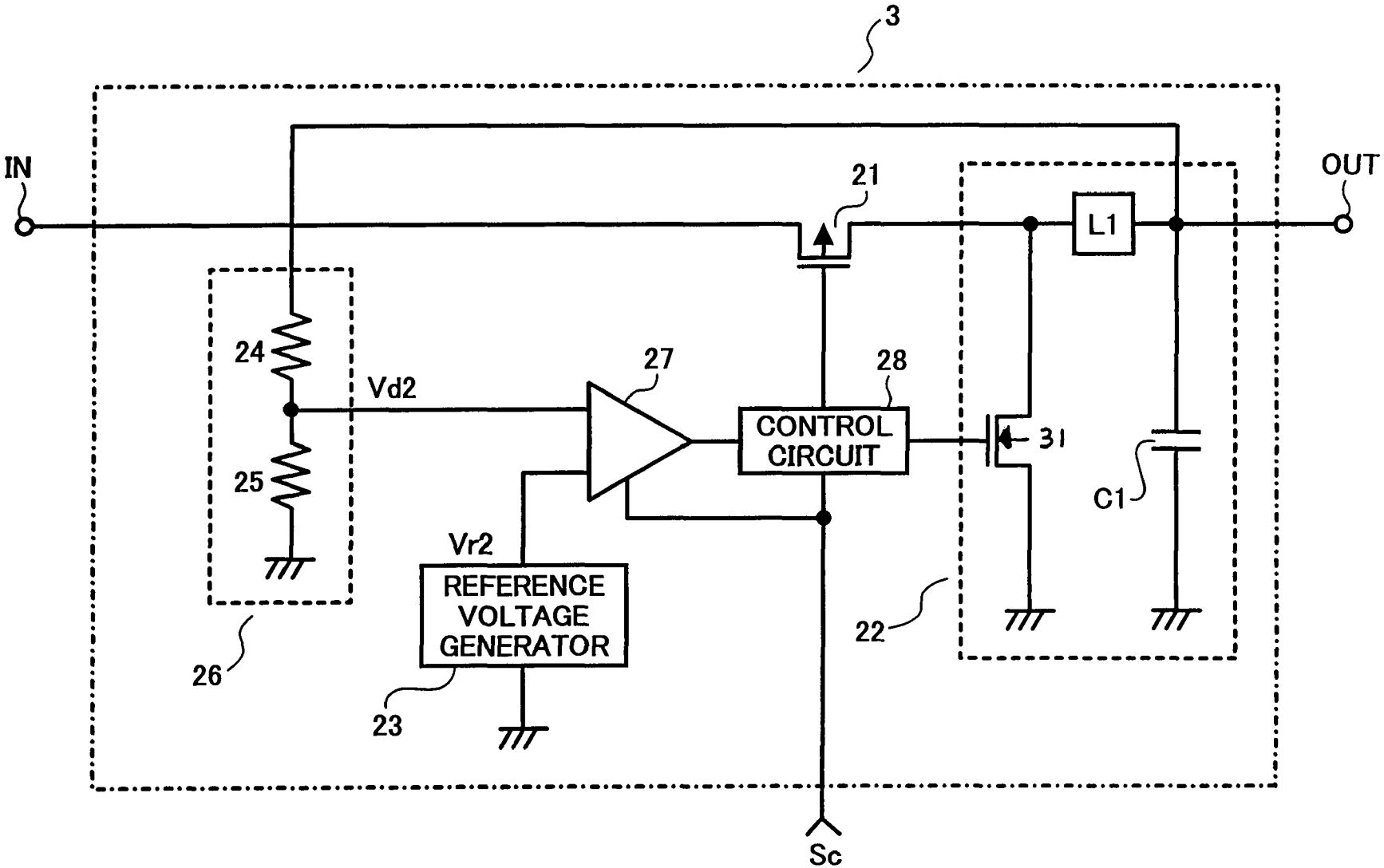

The diode D1 of the second power supply circuit 3 shown in FIG. 4 can be replaced by an N-channel MOS (metal oxide semiconductor) transistor 31, as shown in FIG. 5. Such use of the NMOS transistor 31 for the flywheel diode D1 is previously known in the art. In this case, the first power supply circuit 2 and several components of the second power supply circuit 3 including the reference voltage generator 23, the voltage divider 26, the operational amplifier 27, the control circuit 28, and the NMOS transistor 31 are integrated into a single IC (integrated circuit). In addition, it is also possible to integrate the switching transistor 21 into this single IC.

In the above-described exemplary embodiments, the second power supply circuit 3 of the DC power supply apparatus 1 is a switching regulator. It is, however, also possible to use a series regulator, instead of a switching regulator, in the second power supply circuit 3. In FIG. 6, the second power supply circuit 3 includes a reference voltage source 35, a voltage divider 38, an output control transistor 39, and an operational amplifier 40. The reference voltage source 35 generates and outputs a predetermined reference voltage Vr3. The voltage divider 38 includes resistors 36 and 37, and divides the output voltage Vo to output a voltage Vd3. The operational amplifier 40 controls the operations of the output control transistor 39 such that the voltage Vd3 output from the voltage divider 38 becomes substantially equal to the reference voltage Vr3 output by the reference voltage source 35.

In the second power supply circuit 3 having the above-described structure, the operational amplifier 40 amplifies a difference between the voltage Vd3 output from the voltage divider 38 and the reference voltage Vr3 output from the reference voltage source 35 and outputs the resultant voltage to the gate of the output control transistor 39. In this way, the operational amplifier 40 controls the output control transistor 39 to regulate the output voltage Vo to a desired constant voltage. The operational amplifier 40 changes its operation status in response to the control signal Sc. That is, the operational amplifier 40 enters its operative state when the control signal Sc is in the low state and enters its non-operative state when the control signal Sc is in the high state. In the high state, the output control transistor 39 turns off and enters an interrupted state, thereby stopping the output of a non-zero voltage to the output terminal OUT. As a result, it becomes possible to reduce the power consumption of the second power supply circuit 3 to an almost zero level.

With the above-described structure of the second power supply circuit 3, it is possible to integrate the first and second power supply circuits into a single IC (integrated circuit).

As described above, the DC power supply apparatus 1 is provided with first and second power supply circuits 2 and 3; the first power supply circuit 2 is a power supply circuit that operates at a relatively high efficiency when it supplies a fixed voltage to a relatively light load that consumes a relatively small current; the second power supply circuit 3 is a power supply circuit that operates at a relatively high efficiency when supplying a fixed voltage to a relatively heavy load that consumes a relatively large current but that operates at decreased efficiency when supplying a fixed voltage to a relatively light load. These first and second power supply circuits 2 and 3 are each, as described above, connected in series between the input terminal IN and the output terminal OUT so that the first power supply circuit 2 detects the output of the second power supply circuit 3 and controls the output voltage to the output terminal OUT. This structure eliminates the need for an addition control signal to the first power supply circuit 2 for switching operative and non-operative states thereof. Therefore, it becomes possible to downsize the circuit and to reduce the manufacturing cost accordingly.

FIG. 7 shows a direct current (DC) power supply apparatus 1*a* according to another exemplary embodiment of the present invention. The DC power supply apparatus 1*a* of FIG. 7 is similar to the DC power supply apparatus 1 of FIG. 2, except for the addition of a diode 45 which functions as a switching element. In the case of the DC power supply apparatus 1 shown in FIG. 2, the first power supply circuit 2 is turned off into a non-operative or interrupted state while the second power supply circuit 3 outputs a fixed voltage. A difference of the DC power supply apparatus 1*a* from DC power supply apparatus 1 is that, the additional switching element between the first power supply circuit 2 and the output terminal OUT is turned off into an interrupted state while the second power supply circuit 3 outputs a fixed voltage and is turned on to allow the first power supply circuit 2 to output voltage to the output terminal OUT while the second power supply circuit 3 does not output the fixed voltage.

It is assumed that the fixed voltage output from the second power supply circuit 3 is set to 1.9 volts. When the control signal Sc is in the low state, the second power supply circuit 3 is in the operative state and the voltage Vo at the output terminal OUT is 1.9 volts. At this time, when the voltage Vo1 output from the first power supply circuit 2 is smaller than the sum of the voltage Vo (i.e., 1.9 volts) and a forward voltage Vth (e.g., approximately 0.6 volts) of the diode 45, the output voltage Vo1 is not output to the output terminal OUT. That is, the output voltage Vo1, which can be set to 2.4 volts, for example, is not output to the output terminal OUT during a time the second power supply circuit 3 is in the operative state.

When the control signal Sc enters its high state, the second power supply circuit 3 becomes non-operative and thereby the output voltage Vo is reduced. Consequently, when the voltage Vo becomes smaller than 1.8 volts, the diode 45 operates as a reverse bias and therefore the output voltage Vo1 is output through diode 45 to the output terminal OUT. It should be noted that the diode 45 can be a diode such as a Schottky barrier diode or the like having a relatively small threshold voltage Vth so that power supply efficiency can be increased by an amount corresponding to the reduction of the forward voltage of the diode 45.

In the DC power supply apparatus 1*a* shown in FIG. 7, the first power supply circuit 2, the diode 45, and several components of the second power supply circuit 3 including the reference voltage generator 23, the voltage divider 26, the operational amplifier 27, and the control circuit 28 are integrated into a single IC (integrated circuit). In addition, the switching transistor 21 of the second power supply circuit 3 can also be integrated into this single IC.

As in the case of the second power supply circuit 3 shown in FIG. 5, it is possible to substitute an N-channel MOS (metal oxide semiconductor) for the diode D1. In this case, the first power supply circuit 2, the diode 45, and several components of the second power supply circuit 3 including the reference voltage generator 23, the voltage divider 26, the operational amplifier 27, the control circuit 28, and the NMOS transistor 31 are integrated into a single IC (integrated circuit). In addition, the switching transistor 21 of the second power supply circuit 3 can also be integrated into this single IC.

Further, the second power supply circuit 3 can be a series regulator. In this case, the first power supply circuit 2, the diode 45, and the second power supply circuit 3 are integrated into a single IC.

In this way, the DC power supply apparatus 1*a* can control whether or not the first power supply circuit 2 outputs the voltage Vo1 without needing an extra control signal to circuit 2: The voltage Vo1, which is output from the first power supply circuit 2 to the output terminal OUT when the second power supply circuit 3 is in the non-operative state, is smaller than the voltage Vo2 output from the second power supply circuit 2 to the output terminal OUT when the second power supply circuit 3 is in the operative state.

In addition, since the first power supply circuit 2 generates and outputs the voltage Vo1 even when the second power supply circuit 3 is in the operative state, undershoot in the voltage Vo can be suppressed even at a transition of the second power supply circuit 3 into the non-operative state after which the first power supply circuit 2 outputs the voltage Vo1 to the output terminal OUT. Therefore, it becomes possible to downsize the capacitor 4 connected in parallel to the load 8.

In the examples described above, a PMOS transistor is used as a control element. It is possible to use one of an HMDS transistor, a junction field effect transistor, and the like in place of the PMOS transistor. Further, it is possible to use one of a PNP transistor, an NPN transistor, and the like in place of the PMOS transistor.

Numerous additional modifications and variations are possible in light of the above teachings. It is therefore to be understood that within the scope of the appended claims, the disclosure of this patent specification may be practiced otherwise than as specifically described herein.

What is claimed as new and desired to be protected by Letters Patent of the United States is:

1. A power supply apparatus, comprising:

a first power supply circuit that converts a source voltage from a direct current power source into a first voltage and providing the first voltage to an output voltage terminal; and a second power supply circuit that converts the source voltage from the direct current power source into a second voltage and provides the second voltage to the output terminal, said second power supply circuit being controlled to be turned on and off, wherein the first power supply circuit is further operable to:

sense an output voltage at the output terminal, determine whether the second power supply circuit is inactivated based on the output voltage sensed at the output terminal, and provide the first voltage to the output terminal when the second power supply circuit is inactivated, and wherein said first and second voltages are unequal.

2. A power supply apparatus as defined in claim 1, wherein the first power supply circuit adjusts an output current to the output terminal so that the voltage detected at the output terminal becomes equal to the first voltage, and the first voltage is smaller than the second voltage.

3. A power supply apparatus as defined in claim 1, wherein the first power supply circuit includes a series regulator comprising:

a first reference voltage generator that generates a first reference voltage;

a first voltage divider that divides a voltage at the output terminal and provides a first divided voltage;

an output control transistor that controls output of a source current supplied by the direct current power source in accordance with a gate signal; and a first operational amplifier that provides the gate signal to the output control transistor such that the first divided voltage from the first voltage divider becomes equal to the first reference voltage.

4. A power supply apparatus as defined in claim 1, wherein the second power supply circuit includes a series regulator comprising:

a third reference voltage generator that generates a third reference voltage;

a third voltage divider that divides a voltage at the output terminal and provides a third divided voltage;

an output control transistor that controls output of a source current supplied by the direct current power source in accordance with a gate signal; and a third operational amplifier that provides the gate signal to the output control transistor such that the third divided voltage from the third voltage divider becomes equal to the third reference voltage.

5. A power supply apparatus as defined in claim 1, wherein the second power supply circuit includes a switching regulator comprising:

a second reference voltage generator that generates a second reference voltage;

a second voltage divider that divides a voltage at the output terminal and provides a second divided voltage;

a switching transistor that controls output of the source voltage supplied by the direct current power source in accordance with a gate signal;

a second operational amplifier that amplifies a difference in voltage between the second reference voltage and the second divided voltage;

a control circuit that changes its state according to a control sign al into one of an active state in which the control circuit controls switching operations of the switching transistor in accordance with an output signal from the second operational amplifier and an inactive state in which the control circuit causes the switching transistor to turn off into an interrupted state; and a smoothing circuit that smoothes a signal output from the switching transistor and provides a resultant signal to the output terminal.

6. A power supply apparatus as defined in claim 5, wherein the first power supply circuit and a portion of the second power supply circuit including the second reference voltage generator, the second voltage divider, the second operational amplifier, and the control circuit are integrated into a single integrated circuit.

7. A power supply apparatus as defined in claim 5, wherein the first power supply circuit and a portion of the second power supply circuit including the second reference voltage generator, the second voltage divider, the switching transistor, the second operational amplifier, and the control circuit are integrated into a single integrated circuit.

8. A power supply apparatus as defined in claim 5, wherein the smoothing circuit includes a transistor that is controlled by the control circuit to operate as a flywheel diode, and the first power supply circuit and a portion of the second power supply circuit including the second reference voltage generator, the second voltage divider, the second operational amplifier, the control circuit, and the transistor of the smoothing circuit are integrated into a single integrated circuit.

9. A power supply apparatus as defined in claim 5, wherein the smoothing circuit includes a transistor that is controlled by the control circuit to operate as a flywheel diode, and the first power supply circuit and a portion of the second power supply circuit including the second reference voltage generator, the second voltage divider, the switching transistor, the second operational amplifier, the control circuit, and the transistor of the smoothing circuit are integrated into a single integrated circuit.

10. A power supply apparatus as defined in claim 5, further comprising a switching element between an output port of the first power supply circuit and the output terminal, the switching element being turned off into an interrupted state while the second power supply circuit provides the second voltage.

11. A power supply apparatus as defined in claim 10, wherein the switching element includes a diode connected in a forward direction between the output port of the first power supply circuit and the output terminal to allow current flow from the output port of the first power supply circuit to the output terminal.

12. A power supply apparatus as defined in claim 10, wherein the first power supply circuit, the switching element, and a portion of the second power supply circuit including the second reference voltage generator, the second voltage divider, the second operational amplifier, and the control circuit are integrated into a single integrated circuit.

13. A power supply apparatus as defined in claim 10, wherein the first power supply circuit, the switching element, and a portion of the second power supply circuit including the second reference voltage generator, the second voltage divider, the switching transistor, the second operational amplifier, and the control circuit are integrated into a single integrated circuit.

14. A power supply apparatus as defined in claim 10, wherein the smoothing circuit includes a transistor that is controlled by the control circuit to operate as a flywheel diode, and wherein the first power supply circuit, the switching element, and a portion of the second power supply circuit including the second reference voltage generator, the second voltage divider, the second operational amplifier, the control circuit, and the transistor of the smoothing circuit are integrated into a single integrated circuit.

15. A power supply apparatus as defined in claim 10, wherein the smoothing circuit includes a transistor that is controlled by the control circuit to operate as a flywheel diode, and wherein the first power supply circuit, switching element, and a portion of the second power supply circuit including the second reference voltage generator, the second voltage divider, the switching transistor, the second operational amplifier, the control circuit, and the transistor of the smoothing circuit are integrated into a single integrated circuit.

16. A power supplying method for supplying voltage at an output voltage terminal, comprising:

supplying a source voltage;

in response to sensing a voltage at an output voltage terminal, converting the source voltage into a first voltage and providing the first voltage to the output terminal; and in response to a control signal, converting the source voltage into a second voltage and providing the second voltage to the output terminal;

sensing an output voltage at the output terminal;

determining whether the second power supply circuit is inactivated based on the output voltage sensed at the output terminal; and providing the first voltage to the output terminal when the second power supply circuit is inactivated, wherein said first and second output voltages are unequal.

17. A power supply apparatus, comprising:

a first power supply circuit that converts a source voltage from a direct current power source into a first voltage and provides the first voltage to an output voltage terminal; said first power supply comprising;

a first reference voltage generator that generates a first reference voltage, a first voltage divider that divides a voltage at the output terminal and provides a first divided voltage, an output control transistor that controls output of a source current supplied by the direct current power source in accordance with a gate signal, and a first operational amplifier that provides the gate signal to the output control transistor such that the first divided voltage from the first voltage divider becomes equal to the first reference voltage; and a second power supply circuit that converts the source voltage from the direct current power source into a second voltage and provides the second voltage to the output terminal, said second power supply circuit being controlled to be turned on and off, wherein the first power supply circuit is further operable to:

sense an output voltage at the output terminal, determine whether the second power supply circuit is inactivated based on the output voltage sensed at the output terminal, and provide the first voltage to the output terminal when the second power supply circuit is inactivated, and wherein the first power supply circuit adjusts an output current to the output terminal so that the voltage detected at the output terminal becomes equal to the first voltage, and the first voltage is smaller than the second voltage.

* * * * *